United States Patent [19]

Robins

[11] 4,449,688

[45] May 22, 1984

[54] MEANS FOR CAUSING A SUSPENSIBLE PICTURE FRAME

[76] Inventor: Thomas S. Robins, 2151 Palomino Dr., Warrington, Pa. 18976

[21] Appl. No.: 482,274

[22] Filed: Apr. 11, 1983

Related U.S. Application Data

[63] Continuation of Ser. No. 236,668, Feb. 23, 1981, abandoned.

[51] Int. Cl.[3] ..... A47G 1/16

[52] U.S. Cl. ..... 248/498; 248/476; 248/494

[58] Field of Search ..... 248/494, 144, 145, 131, 248/498, 495, 496, 497, 476, 477, 489; 40/157, 158 A, 152.1, 145; 308/6 R, 6 C

[56] References Cited

U.S. PATENT DOCUMENTS

| | | | |
|---|---|---|---|
| 1,510,877 | 10/1924 | Wiedenmann | 248/118.5 |
| 1,627,635 | 5/1927 | Craig | 248/118.5 |
| 1,944,203 | 1/1934 | Wittig | 248/494 |
| 2,180,211 | 11/1939 | Kellogg | 248/494 |
| 2,440,527 | 4/1948 | Talley | 248/118.5 |
| 3,294,356 | 12/1966 | Sherman | 248/476 |
| 3,302,594 | 2/1967 | Barnett et al. | 248/131 |
| 3,356,424 | 12/1967 | Edwards | 308/6 R |
| 3,975,064 | 8/1976 | Nilsson | 308/6 C |
| 4,244,549 | 1/1981 | Oldfield | 248/494 |
| 4,309,017 | 1/1982 | Slemmons | 248/495 |
| 4,361,366 | 11/1982 | Uchiyama | 308/6 C |
| 4,372,623 | 2/1983 | Koschmieder | 308/6 R |

FOREIGN PATENT DOCUMENTS

| | | | |
|---|---|---|---|
| 1235152 | 3/1960 | France | 308/6 C |

*Primary Examiner*—William H. Schultz
*Assistant Examiner*—Ramon O. Ramirez
*Attorney, Agent, or Firm*—Bernard J. Murphy

[57] ABSTRACT

In the embodiment depicted and described, the invention comprises a retainer for a sphere, having a sphere captive therein, replaceably attached to the reverse side of a picture frame to cause the frame, automatically, to assume a plumb disposition. The sphere, a round ball, is movable within a track formed in the retainer, and a portion thereof projects from the track for rolling engagement with the surface of a wall from which the frame is suspended. In use, a pair of the ball-retainers are fixed to the reverse side of the frame, at spaced apart locations, with the tracks lying substantially along arcs drawn from a suspension point on the frame which intersects the frame center of gravity.

8 Claims, 3 Drawing Figures

REAR VIEW

REAR VIEW

MEANS FOR CAUSING A SUSPENSIBLE PICTURE FRAME

This application is a continuation of application Ser. No. 236,668, filed Feb. 23, 1981, now abandoned.

This invention pertains to hangers for picture frames, mirrors, and the like, generally, and in particular to means which facilitate the righting or true vertical orientation of frames, mirrors, and such.

In the prior art there are known devices which will visually indicate that a wall-suspended article is out of plumb disposition. Exemplary thereof is the U.S. Pat. No. 3,294,356, issued to Melvin J. Sherman, for a "Picture Hanger", on Dec. 27, 1966. The Sherman patent teaches the use of a pendant ball, or a ball rolling within a tube, which will visually signal an unwarranted tilt of a picture frame, or the like. The patented structures, however, require human intervention to correct the suspension of the suspended article. When picture frames and the like are righted, i.e., set in plumb disposition, they are easily and repeatedly put out of plumb disposition by single vibrations, impacts made against the wall from which they hang, etc. Along considerable lengths or widths of the frames, mirrors, and the like, are frictional engagements with the supporting wall surface. Thus, if a vibration or shock upsets the true plumb disposition of the suspended article, the askew or non-vertical suspension thereof will be retained, because of the lengthy frictional engagement which obtains.

What has been needed, and not set forth in any known prior art, is a means for causing a suspensible picture frame, and the like, to assume a plumb disposition automatically—when first hung on its center of gravity, and thereafter, regardless of vibrations, shocks, and whatever.

It is an object of this invention, then, to meet the aforesaid need. Especially is it an object of this invention to set forth, for a first means, comprising a picture frame, a mirror, and the like, which is suspensible from a substantially vertical second means, such as a door, a wall, and the like, means for interpositioning between such first and second means for causing such first means, automatically, to assume a plumb disposition, comprising a rolling element retainer; and a rolling element carried by said retainer.

It is also an object of this invention to disclose, in combination with an article, such as a picture frame, a mirror, and the like, which is suspensible from a substantially vertical member, such as a door, a wall, and the like, means replaceably attached to said article for causing the latter, automatically, to assume a plumb disposition, comprising a plurality of rolling element retainers; and a rolling element carried by each one of said retainers.

Further objects of this invention, as well as the novel features thereof, will become more apparent by reference to the following description, taken in conjunction with the accompanying figures, in which.

Figure 1:
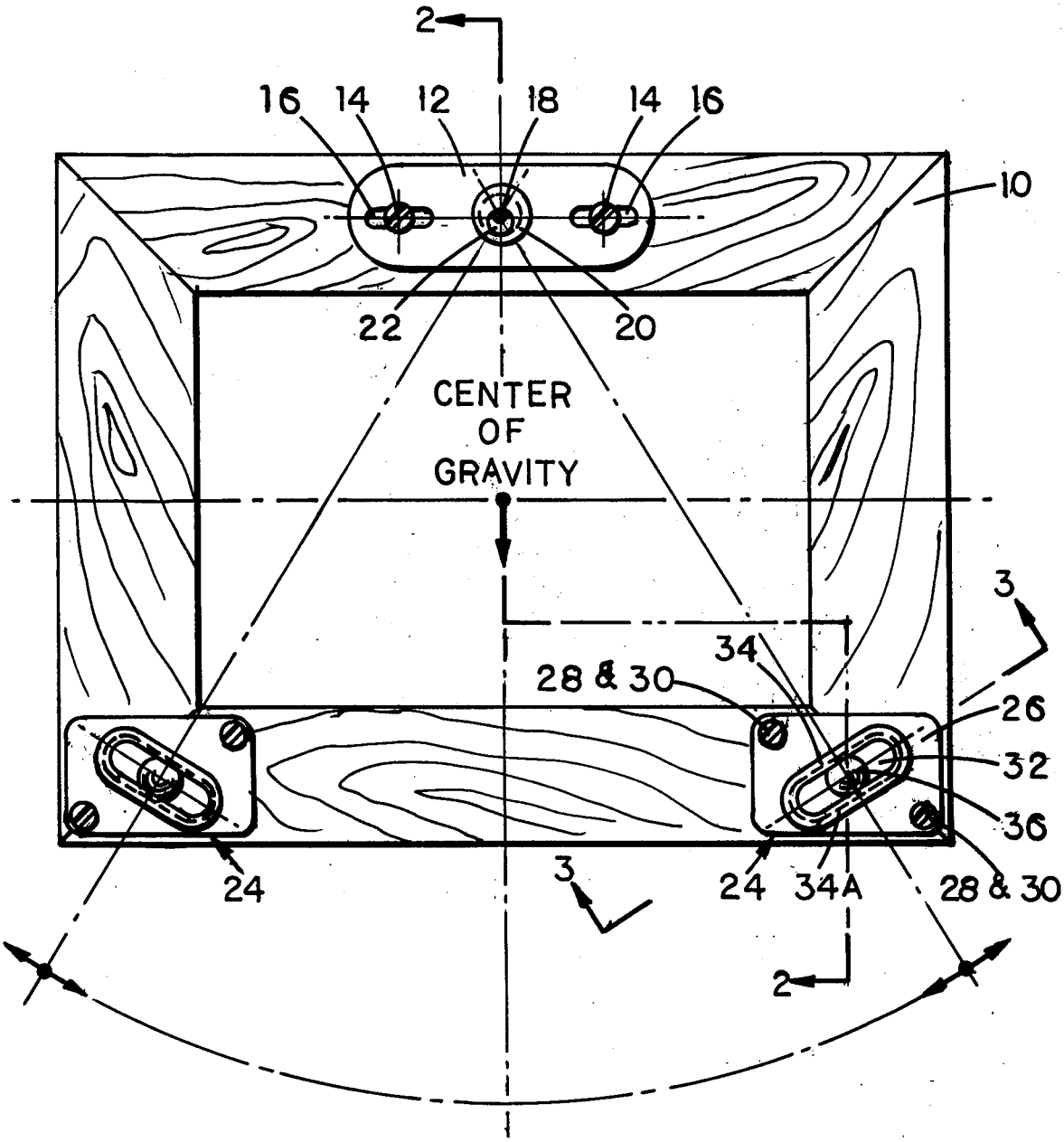
FIG. 1 is a rear, elevational view of a picture frame to which, in replaceable attachment, are a pair of the novel means.

As shown in the figures, a picture frame 10 has a suspension bracket 12 fixed to the upper, center portion thereof by means of fasteners 14. The fasteners 14 occupy slots 16 along which the bracket 12 may be adjustably positioned, in order that the frame 10 will be suspended in true plumb disposition. When the optimum positioning of the bracket 12 is determined, the fasteners 14 are tightened against the slots 16. Centrally of the bracket 12 is a nail 18, the head of which is captive in an apertured boss 20. The boss 20 has an opening 22, in the lower portion thereof, through which the head of the nail 18 may pass.

To suspend the frame 10 from a wall 23, the nail 18 is driven into the wall at a desired location. Then, the opening 22 is passed over the head of the nail 18 to engage the latter with the bracket 12. If the suspension is not of plumb disposition, the frame is removed—again, by passing the opening 22 over the head of the nail 18—and the aforesaid adjustment of the bracket 12, relative or along the slots 16, is made to effect the correction. Then, the frame 10 is again suspended from the nail 18.

In each lower corner of the frame 10 is a replaceably attached ball-retainer 24. Each retainer 24 is a mirror image of the other, so the ensuing description of one will serve for the other as well.

Figure 2:
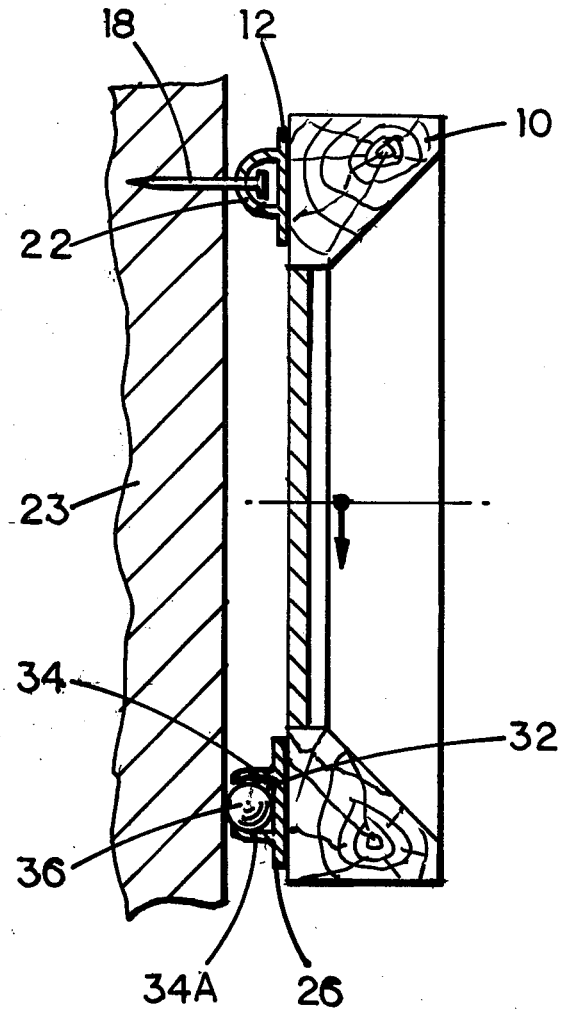
FIG. 2 is a cross-sectional view, taken along section 2—2 of FIG. 1.
Figure 3:
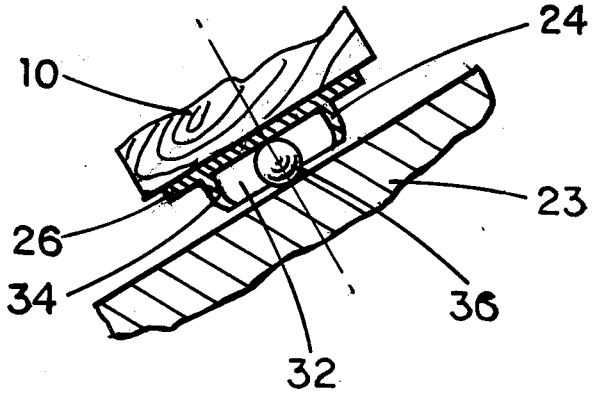
FIG. 3 is a cross-sectional view, taken along section 3—3 of FIG. 1.

Each retainer 24 comprises a plate 26 having holes 28 formed therein for fasteners 30; by means of the latter, the retainers are secured to the frame 10. The retainers 24 have ball tracks 32 formed thereon, the same comprising substantially parallel walls which, through arcuate sectors, define the ends of the tracks. The walls 34 and **34*a* have a first width therebetween whereat they rise from the plate 26, and a second, narrower width therebetween whereat they terminate in elevation. As shown in the figures, particularly FIGS. 2 and 3, by the uniform cross-hatching of the plate 26 and the walls 34 and 34*a*, the retainers 24 are of one-piece construction. Captive therewithin is a ball 36. The ball 36 has a diameter which is greater than the aforesaid second width, and less than the aforesaid first width. Accordingly, the ball 36 is free to roll along the track 32 as well as along the surface of the wall 23**.

The ball 36, accordingly, makes a single point contact, a rolling point contact, with the plate 26, and only a pair of point contacts, on opposite sides thereof, with the walls 34 and **34*a* as it moves along its track 32. Too, the ball 36 always has an area of open track 32 presented thereto to accommodate a free displacement of the ball 36 from any given positioning thereof, relative to the track 32, to another positioning spaced apart therefrom. This light, very limited retention of the ball 36, which leaves the latter substantially free and unencumbered, allows it to respond to almost insignificant gravitational forces arising between the frame 10**, and a vertical wall upon which it is suspended, upon the frame being out of plumb.

The nail 18, or the boss 20 in which it is located, defines the suspension point of the frame 10. Now, arcs drawn from that suspension point find the tracks 32 lying therealong, substantially. This arises from the fact that the tracks 32 are disposed diagonally; the axes thereof traverse the longitudinal axes of the plates 26.

Picture frames, mirrors, and like wall-suspensible articles, when fitted with the novel retainers 24, automatically assume a plumb disposition if the hang thereof is disturbed by vibration, shock, and the like. They become self-righting.

In its essentials, the invention comprises interposing a rolling element between the rear surface of a wall-suspensible article and the vertical member surface. Simply, the invention can be practiced with a single retainer, similar to retainers 24, fastened in line with the center of gravity of a frame, mirror, or the like, and at the lower half of the suspended article. In this practice of the invention, the ball track 32 would have its axis aligned with the elongate axis of the retainer, or that is to say, in a horizontal attitude. In fact, by only placing one or more balls behind a properly hung picture frame or mirror, at the bottom thereof, one interrupts the frictional engagement of the latter with the surface of the wall from which the article is hung, and will realize the benefit of my inventive teaching. Accordingly, while I have described my invention in connection with a specific embodiment thereof, it is to be clearly understood that this is done by way of example, and not as a limitation to the scope of my invention as set forth in the objects thereof and in the appended claims.

I claim:

1. For a first means, comprising a picture frame, a mirror, and the like, which is suspended from a substantially vertical second means, such as a door, a wall, and the like, means for interpositioning between such first and second means for causing said first means, automatically, to assume a plumb disposition, comprising:

a single, one-piece component which defines a rolling element retainer;

said rolling element retainer having means for holding a rolling element therewithin; and a single rolling element held by said retainer; wherein said rolling element comprises a ball, of a given diameter, rotatable about a plurality of axes;

said holding means of said retainer comprises means for accommodating rotation of said rolling element about a plurality of axes; and said retainer comprises a substantially uniplanar plate, and a pair of substantially parallel members, joined to said plate, said plate and pair of members defining an elongate track of a given length; wherein said rolling element makes only rolling point contacts with said pair of members, during rotation thereof; and said given length of said track is greater in dimension than said given diameter of said ball and, as a consequence thereof, a portion of said track defines a void (a) open to said rolling element, and (b) along which said rolling element is free to displace from a first position thereof relative to said track to a second position thereof, relative to said track, which is spaced apart from said first position.

2. Plumb disposition assumption-causing means, according to claim 1, wherein:

said retainer comprises means rendering said retainer replaceably attachable to at least one of said first and second means.

3. Plumb disposition assumption-causing means, according to claim 1, wherein:

said track-defining means comprises a pair of parallel, upstanding walls;

said walls define a first width therebetween whereat they join said plate, and define a second width therebetween whereat the upstanding ends thereof terminate; and said rolling element has a diameter which is intermediate said first and second widths.

4. Plumb disposition assumption-causing means, according to claim 3, wherein:

said first width is greater than said first width; and said rolling element is a sphere.

5. Plumb disposition assumption-causing means, according to claim 1, wherein:

said plate has an elongate axis; and said track has an elongate axis which traverses said elongate axis of said plate.

6. In combination with an article, such as a picture frame, a mirror, and the like, which is suspensible from a substantially vertical member, such as a wall, a door, and the like, means replaceably attached to said article for causing the latter, automatically, to assume a plumb disposition, comprising:

a plurality of single, one-piece components which define rolling element retainers, each of said components having means for holding a rolling element therewithin; and a single rolling element held by each one of said retainers; wherein each of said rolling elements comprises a ball, of a given diameter, rotatable about a plurality of axes;

each of said holding means comprises means accommodating rolling movement of the rolling element, held by said retainer thereof, in different ones of said plurality of axes; and each of said retainers comprises a substantially uniplanar plate and a pair of substantially parallel members, joined to said plate, said plate and said pair of members defining an elongate track of a given length; wherein said given length of said track, of each said retainer, is greater in dimension than said given diameter of each of said balls and, as a consequence thereof, a portion of each said track defines a void (a) open to the rolling element held thereby, and (b) along which said rolling element is free to displace from a first position thereof relative to said track to a second position thereof, relative to said track, which is spaced apart from said first position; and said rolling elements make only a pair of point contacts with their associated track-defining pair of parallel members, during displacement thereof from a first position relative to said track to a second position thereof.

7. The combination, according to claim 6, wherein:

said article has obverse and reverse sides; and said retainers are attached to said reverse side of said article in spaced apart locations.

8. The combination, according to claim 6, wherein:

said article has a center of gravity, and a suspension point, on said reverse side, which intersects said center of gravity;

said retainers have means defining elongate tracks; and said tracks lie substantially along arcs drawn from said suspension point.

* * * * *